US010016034B2

(12) United States Patent
Lee

(10) Patent No.: US 10,016,034 B2
(45) Date of Patent: Jul. 10, 2018

(54) LUGGAGE

(71) Applicant: Thomas Yu Lee, Hillsborough, CA (US)

(72) Inventor: Thomas Yu Lee, Hillsborough, CA (US)

( * ) Notice: Subject to any disclaimer, the term of this patent is extended or adjusted under 35 U.S.C. 154(b) by 0 days.

(21) Appl. No.: 15/438,348

(22) Filed: Feb. 21, 2017

(65) Prior Publication Data

US 2018/0160783 A1 Jun. 14, 2018

(30) Foreign Application Priority Data

Dec. 13, 2016 (TW) ..... 105218968 A

(51) Int. Cl.

| | |
|---|---|
| ***A45C 13/02*** | (2006.01) |
| ***A45C 5/14*** | (2006.01) |
| ***A45C 13/26*** | (2006.01) |
| ***A45C 13/10*** | (2006.01) |
| ***A45C 13/03*** | (2006.01) |

(52) U.S. Cl.

CPC ..... *A45C 5/14* (2013.01); *A45C 13/03* (2013.01); *A45C 13/103* (2013.01); *A45C 13/262* (2013.01); *A45C 2013/267* (2013.01)

(58) Field of Classification Search

CPC ..... A45C 13/02; A45C 13/262; A45C 5/146

USPC ..... 190/115, 18 A

See application file for complete search history.

(56) References Cited

U.S. PATENT DOCUMENTS

| | | | | |
|---|---|---|---|---|
| 3,141,536 | A * | 7/1964 | Fulton | A45C 13/103 190/119 |
| 5,706,921 | A * | 1/1998 | Wang | A45C 13/262 16/403 |
| 6,585,090 | B2 * | 7/2003 | Harvey | A45C 5/04 190/108 |
| 9,072,653 | B2 * | 7/2015 | Nemard | A61J 1/03 |
| 2004/0154889 | A1 * | 8/2004 | Gifford | A45C 5/14 190/18 A |
| 2005/0109072 | A1 * | 5/2005 | Ling | A44B 19/301 70/68 |
| 2006/0087432 | A1 * | 4/2006 | Corbett, Jr. | G06Q 10/08 340/572.1 |
| 2007/0053948 | A1 * | 3/2007 | Ammon, Jr. | A61L 12/086 424/405 |
| 2009/0064456 | A1 * | 3/2009 | Chen | A45C 5/14 16/113.1 |
| 2011/0247910 | A1 * | 10/2011 | Darvish | A45C 5/146 190/18 A |

(Continued)

*Primary Examiner* — Sue A Weaver

(74) *Attorney, Agent, or Firm* — Christensen, Fonder, Dardi & Herbert PLLC

(57) ABSTRACT

A luggage having a case assembly, a buffer module, a pull rod module, and a plurality of wheel sets is provided. The case assembly has a first case body, a second case body, and a hold space, the second case body is correspondingly disposed to the first case body, and the hold space is defined by the first case body and the second case body. The buffer module is disposed in the hold space. The pull rod module is telescopically disposed on the second case body. The plurality of wheel sets are disposed on a concave portion of the first case body and the second case body separately. The first case body can be combined with the second case body by a pivot structure, so the first case body can pivot along the long side of the case assembly to achieve the open and close process.

9 Claims, 6 Drawing Sheets

(56) References Cited

U.S. PATENT DOCUMENTS

| | | | | |
|---|---|---|---|---|
| 2015/0150348 | A1* | 6/2015 | Wax | A45C 5/03<br>190/18 A |
| 2015/0292936 | A1* | 10/2015 | Sheikh | A45C 5/03<br>190/115 |

* cited by examiner

LUGGAGE

This application claims priority to Taiwan Patent Application No. 105218968 filed on Dec. 13, 2016, which is hereby incorporated by reference in its entirety.

CROSS-REFERENCES TO RELATED APPLICATIONS

Not applicable.

BACKGROUND OF THE INVENTION

Field of the Invention

The present invention relates to a luggage, and more particularly, to a luggage for a user to hold wearable equipment for car racing.

Descriptions of the Related Art

Racers participating in high-risk speed races need to wear wearable equipment conforming to racing specifications in order to ensure safety and to protect them from injuries during the races.

Racers participating in car racing usually need to carry about the following wearable equipment: safety helmet, head and neck support (HANS) system, car racing shoes, gloves, car racing suit, fireproof suit and so on. Although most of the wearable equipment has the functions of wear-resisting, water-resisting and so on, they still need to be holded properly when being received so as to avoid inadvertent damage due to collisions, friction or water immersion when being carried about, and otherwise, the racing process would be affected or the life of the racers would be endangered. Besides, disordered holding also tends to cause missing of the wearable equipment due to momentary oversight or due to a hurry.

Accordingly, an urgent need exists in the art to provide a luggage for a racer to conveniently hold various kinds of wearable equipment for car racing and to maintain integrity of the wearable equipment.

SUMMARY OF THE INVENTION

An objective of the present invention is to provide a luggage that is adapted for a racer to conveniently and effectively hold wearable equipment for car racing and that reduces damages of water or collisions to the luggage so as to ensure integrity of the equipment.

To achieve the aforesaid objective, the luggage of the present invention comprises a case assembly, a buffer module, a pull rod module and a plurality of wheel sets. The case assembly has a first case body, a second case body and a hold space, the second case body is correspondingly disposed to the first case body, and the hold space is defined by the first case body and the second case body. The buffer module is disposed in the hold space, the pull rod module is telescopically disposed on the second case body, and the wheel sets are disposed on a concave portion of the first case body and the second case body separately. The first case body is combined with the second case body by a pivot structure so that the first case body is adapted to pivot along a long side of the case assembly to achieve the open and close process.

To achieve the aforesaid objective, the buffer module of the luggage of the present invention comprises a first buffer element and a second buffer element, the first buffer element and the second buffer element are closely disposed in the first case body and the second case body, the first buffer element has a plurality of first concaves of different shapes, the second buffer element has a plurality of second concaves disposed opposite to the first concaves to completely cover a plurality of parts of the wearable equipment.

To achieve the aforesaid objective, the first concaves and the second concaves of the buffer module of the luggage of the present invention are arranged from the lower side of the case assembly to the upper side of the case assembly in a descending order of respective sizes.

To achieve the aforesaid objective, the pull rod module of the luggage of the present invention comprises a pull rod, a telescopic element and two hanger structures, two ends of the telescopic element are fixed to the pull rod and the second case body respectively, and the two hanger structures are disposed at a left end and a right end of the pull rod in a concealed manner respectively.

To achieve the aforesaid objective, the pull rod of the luggage of the present invention is adapted to be received in an inside concave of the second case body when the telescopic element is in a received state.

To achieve the aforesaid objective, the second case body of the case assembly of the luggage of the present invention is adapted to fix the pull rod through magnetic adsorption.

To achieve the aforesaid objective, the luggage of the present invention further comprises a locking structure disposed at a bottom portion of the case assembly to lock the first case body and the second case body.

To achieve the aforesaid objective, the luggage of the present invention further comprises a waterproof zipper disposed at a junction between the first case body and the second case body.

To achieve the aforesaid objective, the luggage of the present invention further comprises a sensor which may be a sensing element or a positioning element.

To achieve the aforesaid objective, the sensor of the luggage of the present invention comprises a Radio Frequency IDentification (RFID) element.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

The present invention relates to a luggage that is adapted for a user (e.g., a racer) to conveniently and effectively hold wearable equipment for car racing (e.g., a safety helmet, a HANS system, car racing shoes, gloves, a car racing suit, a fireproof suit and so on) and that reduces damages of water or collisions to the luggage so as to ensure integrity of the equipment.

Figure 1:
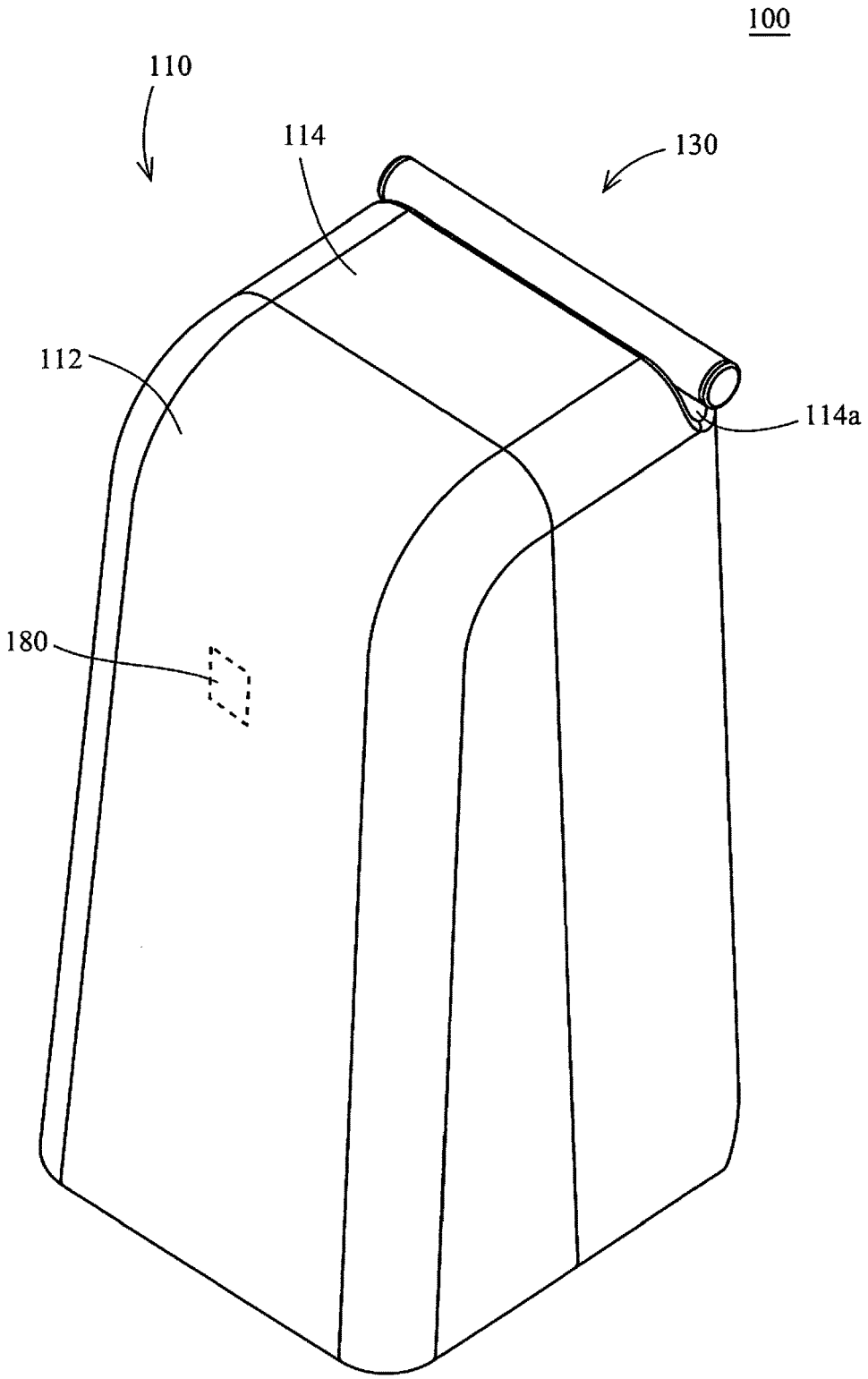
FIG. 1 is a perspective view of a luggage according to the present invention.
Figure 2:
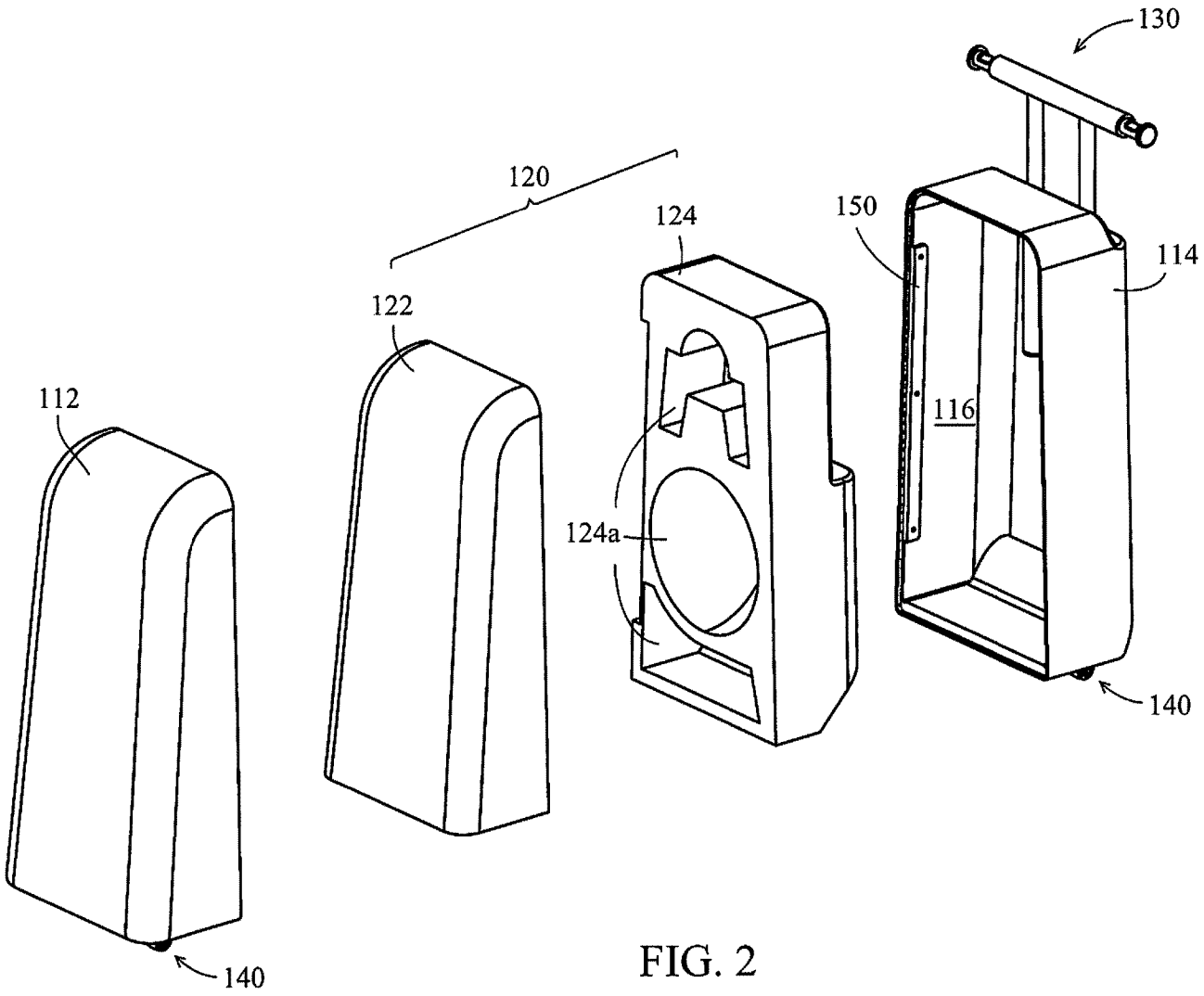
FIG. 2 is an exploded view of the luggage according to the present invention.

As shown in FIG. 1 and FIG. 2, the luggage 100 of the present invention comprises a case assembly 110, a buffer module 120, a pull rod module 130 and a plurality of wheel sets 140. In this embodiment, the case assembly 110 has a first case body 112, a second case body 114 and a hold space 116; the second case body 114 is correspondingly disposed to the first case body 112; and the hold space 116 is defined by the first case body 112 and the second case body 114. The buffer module 120 is disposed in the hold space 116. The pull rod module 130 is telescopically disposed on the second case body 114. The wheel sets 140 are disposed on concave portions 118 located at a lower side of the first case body 112 and a lower side of the second case body 114 separately so that the wheel sets 140 are concealed without being damaged due to collisions.

In general usage conditions, because parts of the wheel sets 140 concealed by the concave portions 118 cannot be seen from the outside, a visual effect that the luggage 100 floats on the ground is produced when the luggage 100 is dragged.

Additionally, as shown in the embodiment of FIG. 2, the first case body 112 is combined with the second case body 114 by a pivot structure 150 so that the first case body 112 is adapted to pivot along a long side of the case assembly 110 to achieve the process of opening and closing the luggage 100, thus saving the space necessary for the user to operate the luggage.

Figure 3:
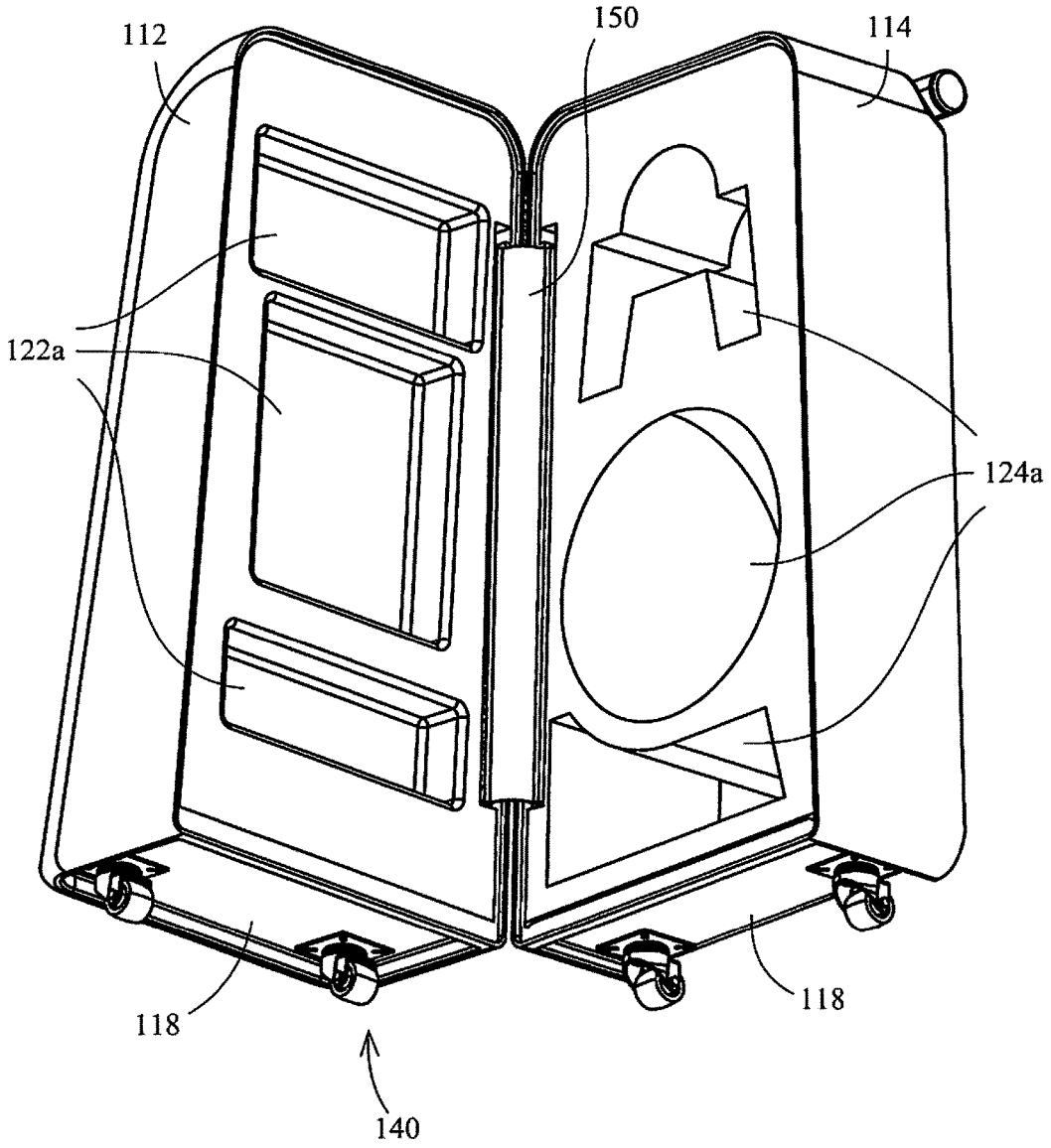
FIG. 3 is a schematic view of the luggage according to the present invention when being opened.

Referring to FIG. 2 and FIG. 3 together, the buffer module 120 of the luggage 100 of the present invention comprises a first buffer element 122 and a second buffer element 124. In this embodiment, the first buffer element 122 and the second buffer element 124 are closely disposed in the first case body 112 and the second case body 114. The first buffer element 122 has a plurality of first concaves 122*a* of different shapes, the second buffer element 124 has a plurality of second concaves 124*a* disposed opposite to the first concaves 122*a* to completely cover such parts of the wearable equipment as a safety helmet, a HANS system, car racing shoes, gloves, a car racing suit or a fireproof suit when the luggage 100 is closed.

In this embodiment, as shown in FIG. 2, the first concaves 122*a* and the second concaves 124*a* are arranged from the lower side of the case assembly 110 to the upper side of the case assembly 110 in a descending order of respective sizes. Thereby, the first concaves 122*a* may be used to hold the car racing suit, the fireproof suit and gloves of the wearable equipment, while the second concaves 124*a* may be correspondingly disposed from the bottom to the top to hold the car racing shoes, the safety helmet and the HANS system of the wearable equipment.

By pre-designing the concaves in this way, the user can neatly arrange the wearable equipment to be carried about without spending too much time and effectively distribute the weight of the luggage so as to drag the luggage 100 more easily; and because the irregularly-shaped concaves may be designed to correspond to the outlines of the pieces of wearable equipment, it is less likely for the user to lose any of the wearable equipment due to momentary oversight or due to a hurry.

Figure 4:
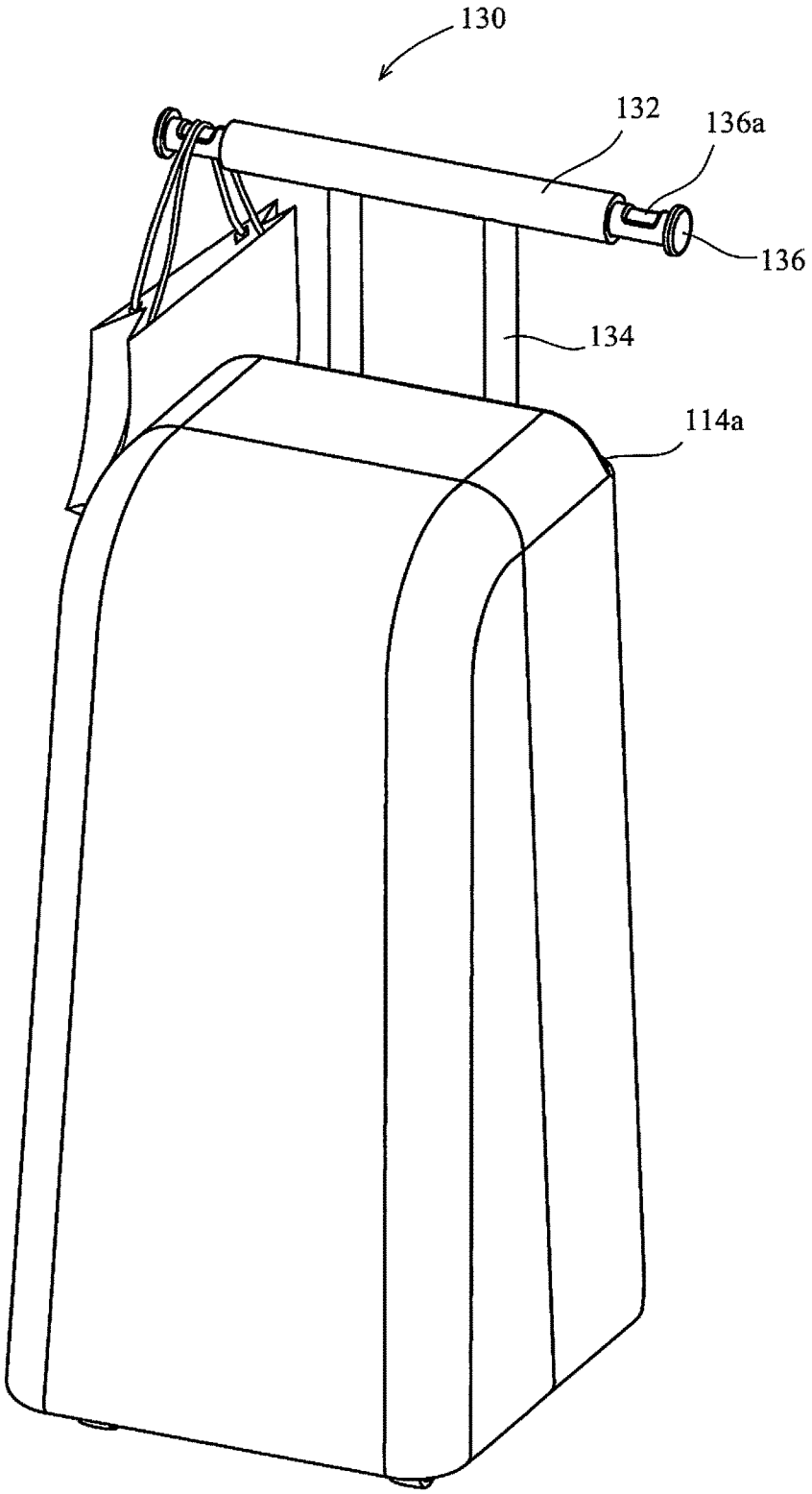
FIG. 4 is a schematic view of the luggage according to the present invention with the hanger structures being extended to hang a bag.

In the present invention, the pull rod module 130 of the luggage 100 further comprises a pull rod 132, a telescopic element 134 and two hanger structures 136. Referring to FIG. 1 and FIG. 4 together, two ends of the telescopic element 134 are fixed to the pull rod 132 and the second case body 114 respectively, and the two hanger structures 136 may be disposed at the left end and the right end of the pull rod 132 in a concealed manner. When the telescopic element 134 is in a received state, the pull rod 132 is adapted to be received in an inside concave 114a of the second case body 114 to provide a neat appearance of the luggage 100. In a preferred embodiment, the inside concave 114a of the second case body 114 is adapted to fix the pull rod 132 through magnetic adsorption.

Figure 5:
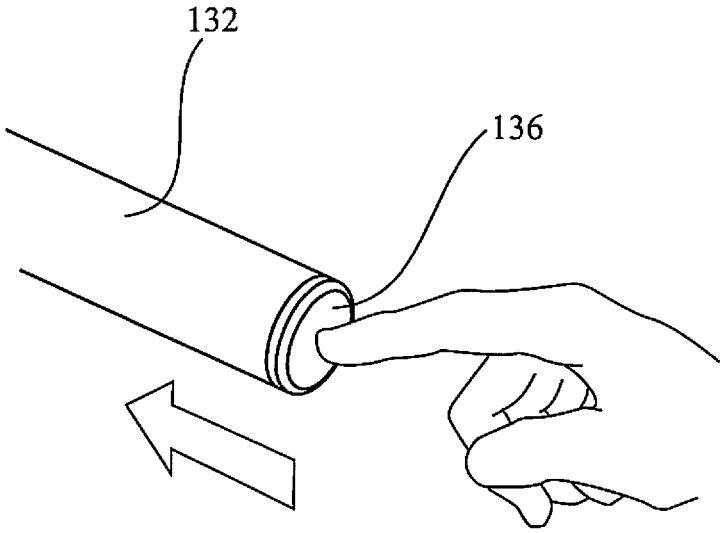
FIG. 5 is a schematic view of a hanger structure of the luggage according to the present invention when being retracted and extended respectively.
Figure 5:
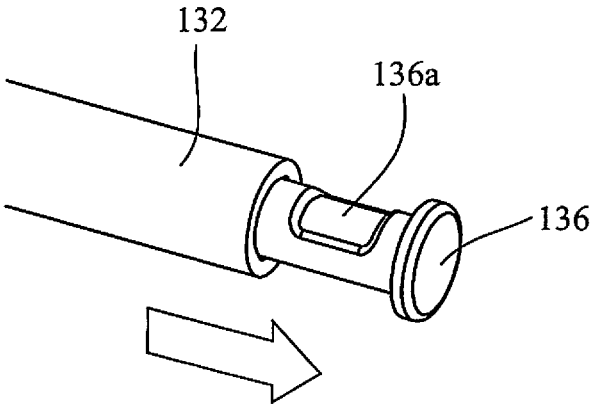

Referring still to FIG. 4, each of the two hanger structures 136 in this embodiment is a pillar-shaped hanger having a concave 136*a* so that the user may hang an article having a handle such as a hand bag or a backpack on the concave 136*a* to prevent sliding of the article from the hanger structures 136. As shown in FIG. 5, through disposition of spring structures, the user can retract the two hanger structures 136 into or extend the two hanger structures 136 from the left end and the right end of the pull rod 132 readily to keep the neat appearance of the luggage 100, but the present invention is not limited thereto. That is, depending on different needs in use, the two hanger structures 136 may also be designed as auxiliary protruding parts that is manually pulled out or concealed by the user.

Figure 6:
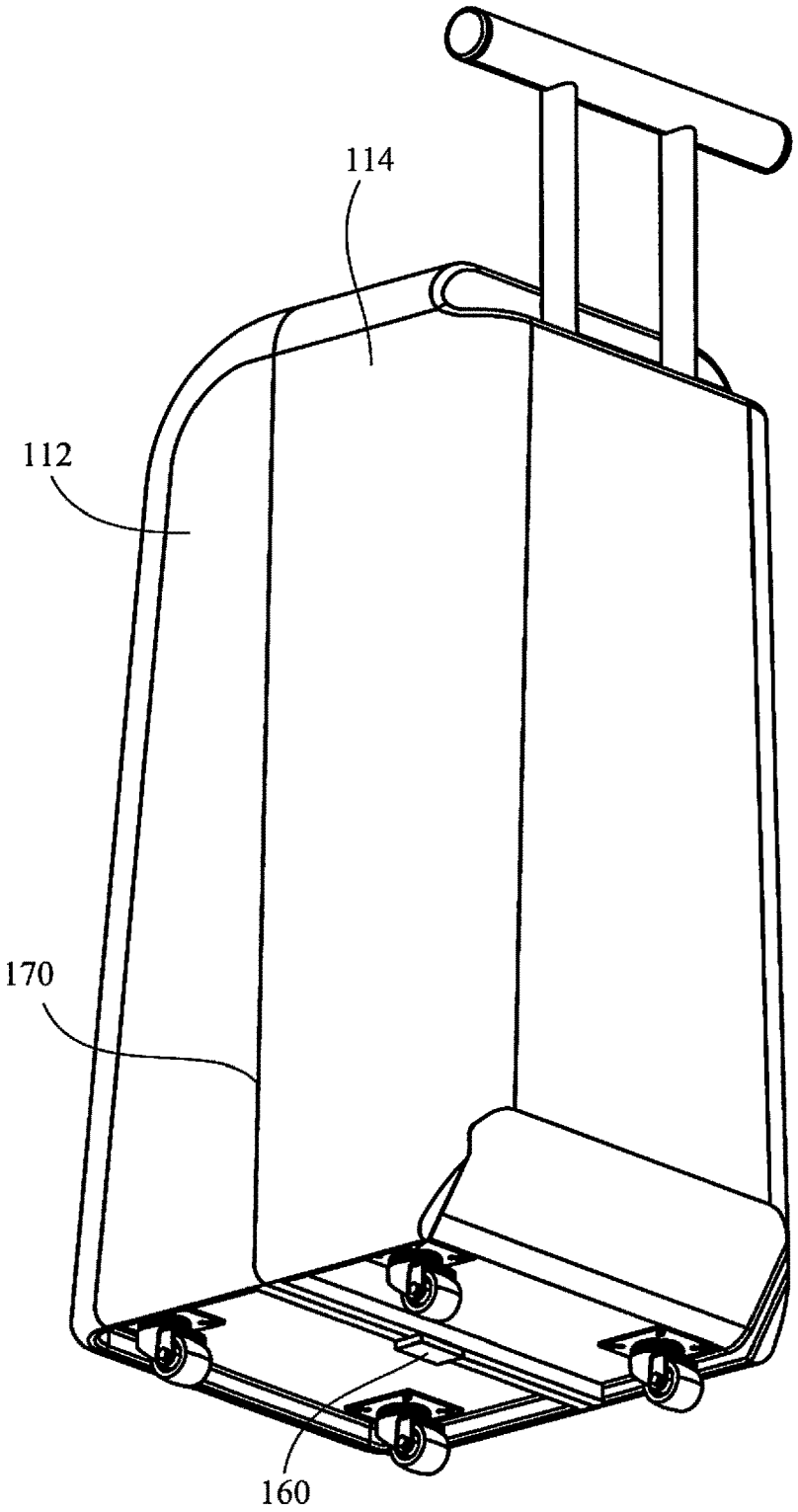
FIG. 6 is a perspective view of the luggage of the present invention from another viewing angle.

Referring to FIG. 6, the luggage 100 of the present invention further comprises a locking structure 160 and a waterproof zipper 170. The locking structure 160 is disposed at a bottom portion of the case assembly 100 to lock the first case body 112 and the second case body 114 and also to keep the neat appearance of the luggage 100. The waterproof zipper 170 is disposed at a junction between the first case body 112 and the second case body 114 to prevent entry of rainwater or other liquid into the hold space 116 which would otherwise damage the internal buffer module 120 or the wearable equipment held in the hold space 116.

On the other hand, as shown in FIG. 1, the luggage 100 of the present invention may further comprise a sensor 180 disposed at a front side of the first case body 112 (i.e., sandwiched between the first case body 112 and the first buffer element 122), and the sensor 180 may be a sensing element or a positioning element. The sensor 180 is preferably a Radio Frequency IDentification (RFID) element that provides an alarm against theft or a tracking or positioning function to reduce the risk of losing the luggage 100 by theft. However, the sensor 180 may also be disposed at a left/right side or on a top surface inside the second case body 114 depending on different needs in use, so the present invention has no limitation on this.

Besides, the buffer module 120 may also be taken out from the luggage 100 of the present invention so that the luggage 100 is used as a general luggage and still has the waterproof function, the theft-prevention function and the function of hanging several hand bag or other bags.

According to the above descriptions, the luggage 100 of the present invention allows the user to conveniently and effectively hold wearable equipment for car racing while still reducing damages of the luggage due to water or collisions to adequately maintain the integrity of the equipment, and through disposition of the hanger structures and the sensor, the luggage 100 of the present invention can provide functions of hanging bags, the theft prevention function or the tracking or positioning function when being used outside. Moreover, if the buffer module 120 is taken out, the luggage can still be used as a general luggage to satisfy different needs in use.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A luggage for a user to hold wearable equipment for car racing, comprising:

a case assembly, having a first case body, a second case body and a hold space, the second case body is correspondingly disposed to the first case body, and the hold space is defined by the first case body and the second case body;

a buffer module, being disposed in the hold space;

a pull rod module, being telescopically disposed on the second case body; and a plurality of wheel sets, being disposed on a concave portion of the first case body and the second case body separately;

wherein parts of the wheel sets are concealed by the concave portions, and the first case body is combined with the second case body by a pivot structure so that the first case body is adapted to pivot along a long side of the case assembly to achieve the open and close process.

2. The luggage according to claim 1, wherein the buffer module comprises a first buffer element and a second buffer element, the first buffer element and the second buffer element are closely disposed in the first case body and the second case body, the first buffer element has a plurality of first concaves of different shapes, the second buffer element has a plurality of second concaves disposed opposite to the first concaves to completely cover a plurality of parts of the wearable equipment.

3. The luggage according to claim 1, wherein the pull rod module comprises a pull rod, a telescopic element and two hanger structures, two ends of the telescopic element are fixed to the pull rod and the second case body respectively, and the two hanger structures are disposed at a left end and a right end of the pull rod in a concealed manner respectively.

4. The luggage according to claim 3, wherein the pull rod is adapted to be received in an inside concave of the second case body when the telescopic element is in a received state.

5. The luggage according to claim 3, wherein the second case body is adapted to fix the pull rod through magnetic adsorption.

6. The luggage according to claim 1, further comprising a locking structure disposed at a bottom portion of the case assembly to lock the first case body and the second case body.

7. The luggage according to claim 1, further comprising a waterproof zipper disposed at a junction between the first case body and the second case body.

8. The luggage according to claim 1, further comprising a sensor which may be a sensing element or a positioning element.

9. The luggage according to claim 8, wherein the sensor comprises a Radio Frequency IDentification (RFID) element.

* * * * *